United States Patent [19]

MacArthur et al.

[11] Patent Number: 4,853,111

[45] **Date of Patent: * Aug. 1, 1989**

[54] TWO-STAGE CO-PROCESSING OF COAL/OIL FEEDSTOCKS

[75] Inventors: James B. MacArthur, Denville; Joseph B. McLean, S. Somerville, both of N.J.; Alfred G. Comolli, Yardley, Pa.

[73] Assignee: HRI, Inc., Lawrenceville, N.J.

[ * ] Notice: The portion of the term of this patent subsequent to Jun. 27, 2006 has been disclaimed.

[21] Appl. No.: 889,587

[22] Filed: Jul. 25, 1986

Related U.S. Application Data

[63] Continuation of Ser. No. 725,457, Apr. 22, 1985, abandoned.

[51] Int. Cl.[4] ..... C10G 1/06; C10G 1/08

[52] U.S. Cl. ..... 208/421; 208/409; 208/422; 208/423; 208/428; 208/434; 208/413

[58] Field of Search ..... 208/413, 417, 434, 59, 208/108

[56] References Cited

U.S. PATENT DOCUMENTS

| | | | |
|---|---|---|---|
| 3,575,847 | 4/1971 | Sprow et al. | 208/10 |
| 3,594,305 | 7/1971 | Kirk, Jr. | 208/10 |
| 3,679,573 | 7/1972 | Johnson | 208/10 |
| 3,700,584 | 10/1972 | Johanson et al. | 208/10 |
| 4,054,504 | 10/1977 | Chervenak et al. | 208/10 |
| 4,111,787 | 9/1978 | Aldridge et al. | 208/413 |
| 4,210,518 | 7/1980 | Wilson | 208/413 |
| 4,313,816 | 2/1982 | Veluswamy et al. | 208/10 |
| 4,316,792 | 2/1982 | Sze et al. | 208/418 |
| 4,316,793 | 2/1982 | Sze | 208/10 |
| 4,345,989 | 8/1982 | Vernon et al. | 208/419 |
| 4,376,695 | 3/1983 | Belinko et al. | 208/10 |
| 4,411,768 | 10/1983 | Unger et al. | 208/108 |
| 4,415,429 | 11/1983 | Stadelhofer et al. | 208/434 |
| 4,422,922 | 12/1983 | Rosenthal et al. | 208/10 |
| 4,431,510 | 2/1984 | Gatsis | 208/10 |
| 4,457,831 | 7/1984 | Gendler | 208/59 |
| 4,510,038 | 4/1985 | Kuehler | 208/10 |
| 4,541,914 | 9/1985 | Hirokoh et al. | 208/413 |
| 4,541,916 | 9/1985 | Beuther et al. | 208/107 |
| 4,552,642 | 11/1985 | Hettinger, Jr. | 208/10 |
| 4,576,710 | 3/1986 | Nongbri et al. | 208/59 |

FOREIGN PATENT DOCUMENTS

| | | | |
|---|---|---|---|
| 0017447 | of 1928 | Australia | 208/413 |
| 3408095 | 9/1984 | Fed. Rep. of Germany | 208/413 |
| 0257484 | 11/1969 | U.S.S.R. | 208/434 |
| 2143843 | 2/1985 | United Kingdom | 208/413 |

*Primary Examiner*—Gary P. Straub
*Attorney, Agent, or Firm*—Fred A. Wilson

[57] ABSTRACT

A process for two-stage catalytic co-processing of coal and heavy petroleum hydrocarbon liquid fractions to produce increased yields of low-boiling hydrocarbon liquid and gas products. In the process, the particulate coal is slurried with a petroleum residuum and optionally with a process-derived hydrocarbon liquid solvent and fed into a first stage catalytic reaction zone operated at relatively mild conditions which promote controlled rate liquefaction of the coal while simultaneously hydrogenating the petroleum and hydrocarbon recycle oils at conditions favoring hydrogenation reactions. The first stage reactor is maintained at 650°-800° F. temperature, 1000-4000 psig hydrogen partial pressure and 10-100 lb/hr/ft$^3$ space velocity for the total coal and oil feed. From the first stage reaction zone, the partially hydrogenated effluent material is passed directly to the close-coupled second stage catalytic reaction zone maintained at more severe conditions of 750°-900° F. temperature for further catalytic; and hydrogenation and hydroconversion reactions. By this process, the blended coal and petroleum feed materials are successively catalytically hydrogenated and hydroconverted at the selected conditions, which results in significantly increased yields of desirable low-boiling hydrocarbon liquid products and minimal production of undesirable residuum and unconverted coal and hydrocarbon gases, while catalyst life is substantially increased.

14 Claims, 1 Drawing Sheet

TWO-STAGE CO-PROCESSING OF COAL/OIL FEEDSTOCKS

This application is a continuation of application Ser. No. 725,457 filed Apr. 22, 1985, now abandoned.

BACKGROUND OF INVENTION

This invention pertains to co-processing coal/oil feedstocks in a two-stage catalytic hydroconversion process. It pertains particularly to such coal/oil co-processing to produce higher percentage hydroconversion and increased yields of low-boiling hydrocarbon distillate liquid products, while yields of hydrocarbon gases and heavy resid materials.

Coal/oil co-processing using a single stage catalytic ebullated bed reactor, has been shown to be an effective technique for simultaneous conversion of coal and residual oils to produce predominantly hydrocarbon liquid products, as disclosed by U.S. Pat. No. 4,054,405 to Chervenak, et al. At high percentage conversion levels, the single stage hydrogenation process produces undesirably high yields of byproduct hydrocarbon gas ($C_1$–$C_3$) and product quality decreases, i.e., the $N_2$ and sulfur contents of the distillate liquid products increase. Several other processes for simultaneous processing of coal and petroleum feeds using two reaction stages have been proposed, such as disclosed by U.S. Pat. Nos. 3,870,621 to Arnold; 4,306,960 to Gleim, and 4,330,390 to Rosenthal, et al. However, these processes all have shortcomings and do not achieve the flexibility and high yields of low-boiling hydrocarbon distillate liquids desired. Significantly improved results have now been achieved by the present two-stage catalytic coal/oil co-processing process for blended coal and oil feedstocks.

SUMMARY OF INVENTION

The present invention provides an improved hydrogenation and hydroconversion process in which particulate coal and heavy liquid hydrocarbon feedstocks are co-processed in a catalytic two-stage ebullated bed reactor system, to produce increased yields of low-boiling hydrocarbon distillate liquids and minimal yields of hydrocarbon gas and high-boiling resid fractions. The coal feed portion exceeds about 25 W% of the total coal and hydrocarbon liquid fresh feed material. The first stage reactor is operated at mild hydrogenation conditions of 650°–800° F. temperature and 1000–4000 psig hydrogen partial pressure and at feedrate or space velocity of 10–100 lb coal and petroleum/hr $ft^3$ reactor volume to increase the hydrogen content of the dissolved coal and oil feed, and recycle oil (if used) molecules, while obtaining moderate conversion of the coal without producing regressive (coke forming) reactions.

The catalyst used in each stage reactor should be selected from the metals group consisting of oxides or other metal compounds of components of cobalt, iron, molybdenum, nickel, tin, tungsten and mixtures thereof and other hydrocarbon hydrogenation catalyst metal oxides known in the art, deposited on a base support material selected from the group consisting of alumina, magnesia, silica, titania, and similar materials. Useful catalyst particle sizes can range from about 0.030 to 0.125 inch effective diameter.

The first stage reactor effluent material containing hydrogen and heteratom gases, hydrocarbon gases, hydrocarbon liquid fractions and heavy unconverted hydrocarbon materials is passed to a direct-coupled second stage catalytic reactor, which is operated at somewhat more severe hydroconversion conditions of 750°–900° F. temperature and 1000–4000 psig hydrogen partial pressure to convert the remaining unconverted coal and residual oil and to produce high yields of high quality distillate liquid products, with minimal yields of hydrocarbon gases and high-boiling resid fractions. The catalyst used is similar or can be the same as that used in the first stage reactor. From the second stage reactor the effluent is phase separated and distilled to provide the combined hydrocarbon liquid distillate products.

This process improvement permits co-processing operations on blended coal and heavy hydrocarbon liquids such as petroleum residuum feedstocks at high conversion to provide increased yields of distillate liquid products, without encountering compatibility problems between the coal-derived and oil-derived products. The addition of a first low severity hydrogenation reaction stage to increase the hydrogen content of the fresh coal and oil feed materials (and recycle oil if present) reduces sulfur and nitrogen compounds in the liquid product and improves the solvent quality of the liquids needed to dissolve the coal, and also significantly improves the overall process performance and allows its successful application to a wider range of feedstocks. Coal conversion in catalytic two-stage co-processing with solvent quality sensitive coals (such as Alberta sub-bituminous coal) are equivalent to that obtained with coal-only process derived solvent. High selectivity to low-boiling hydrocarbon liquids with minimum yields of undesired by-product hydrocarbon gas and residuum is achieved. Also, it has been determined that the Watson characterization factors in relation to the mean average boiling point for the hydrocarbon liquid products produced by the present catalytic two-stage coal/oil co-processing process are intermediate those produced by catalytic two-stage coal liquefaction process and by catalytic petroleum hydroconversion processes.

In the present invention, if the petroleum oil feed having at least 90 V% normally boiling above 650° F. and preferably containing at least about 20 W% aromatic compounds and exceeds that needed for slurrying the particulate coal feed to provide a pumpable fluid mixture, the recycle of hydroconverted hydrocarbon liquids from the distillation step for such slurrying may not be required. Otherwise, such coal recycle of heavy 550° F.+ distilled hydrocarbon fractions to the coal slurrying step is usually done to provide increased conversion and yields of low-boiling hydrocarbon liquid products.

DESCRIPTION OF INVENTION

Figure 1:
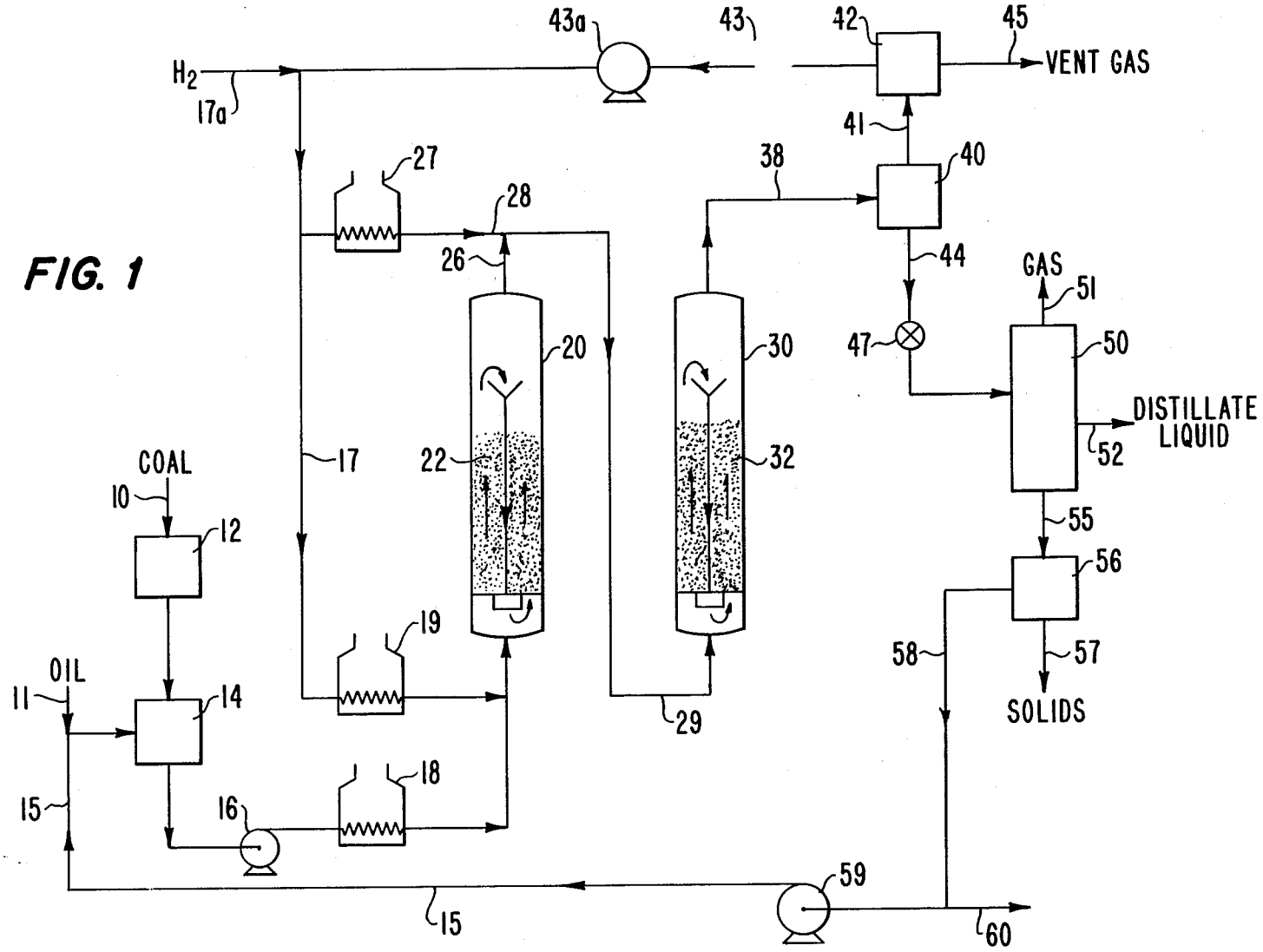
FIG. 1 is a schematic flow diagram of a two-stage catalytic process for hydrogenation and hydroconversion of coal/oil feedstocks according to the present invention.

In the present invention, improved hydrogenation and hydroconversion of blended coal and oil feedstocks is provided in a two-stage catalytic process using ebullated catalyst bed reactors. As is shown in the FIG. 1 process flow diagram for catalytic two-stage coal/oil co-processing, a coal such as bituminous, sub-bituminous or lignite, is provided at 10 and is passed through a coal preparation unit 12, where the coal is ground to a desired particle size such as 50–375 mesh (U.S. Sieve Series) and dried to a desired moisture content such as containing 2–10 W% moisture. The particulate coal is then blended with fresh hydrocarbon liquid feed such as petroleum resid, heavy crude oil, tar sand bitumen, or shale oil provided at 11, and are mixed together at slurry tank 14 to provide a pumpable coal-oil slurry feed material. A total fresh feed oil/coal weight ratio between about 1.0/1 and 3/1 can be used, so that the coal feed is from about 25 W% to about 50 W% of the total coal and oil fresh feed material, not including any recycled oils. If desired, a recycled process-derived slurrying oil at 15 can be additionally mixed with the coal and oil feedstocks. The resulting coal-oil slurry is pumped at 16 to reactor pressure, preheated at 18, mixed with hydrogen gas at 17 preheated at 19 and is fed into the lower end of the first stage reactor 20.

The first stage reactor 20 is preferably a back-mixed catalytic ebullated bed reactor containing catalyst bed 22 and operating at moderate conditions of 650°–800° F. temperature and hydrogen partial pressure of 1000–4000 psig for hydrogenation and hydroconversion of the blended feed materials. In the reactor the blended upflowing coal-oil feed material is effectively contacted with hydrogen in the presence of a particulate hydrogenation catalyst, as generally described in U.S. Pat. No. Re 25,770. Conventional hydrogenation catalysts, including nickel molybdate, cobalt molybdate or nickel-tungsten on alumina or silica support such as employed in the H-coal ® or H-Oil ® Processes are utilized in the well-mixed ebullated bed reactor. Useful total feed rates or space velocities are in the range of 10 to 100 lb coal and hydrocarbon liquid feed/hr $ft^3$ reactor volume for each stage. Preferred first stage reaction conditions are 700°–780° F. temperature and 1500–3500 psig hydrogen partial pressure, with feed rates of 15–75 lb coal and hydrocarbon liquid feed/hr $ft^3$ usually being preferred depending on the particular proportions of coal and oil in the feed and the hydrocarbon desired.

From the first stage reactor 20 the total effluent stream 26 containing less than about 6 W% $C_1$–$C_3$ hydrocarbon gases, 15–25 W% 650° F.-distillate liquids and 60–70 W% 650° F.+ hydrocarbon materials is mixed with additional preheated hydrogen at 28 as needed and is fed as stream 29 directly into the lower end of close-coupled second-stage reactor 30. The added hydrogen is preheated at heater 27 to increase the temperature of the first-stage reactor effluent to the desired higher second stage reactor temperature conditions. The second stage reactor 30 is preferably a back-mixed catalytic ebullated bed reactor containing catalyst bed 32 and operating at essentially the same pressure conditions as the first stage reactor (slightly lower to allow for pressure drop and forward flow of materials) and at higher temperatures of 750°–900° F. utilized for further hydroconversion reactions. The second stage reactor uses catalysts which are similar to those for the first stage reactor. The first and second stage reactors may have equal volumes or they may be substantially different in volume depending on the product yield and product quality objectives. The preferred second stage reaction conditions are 780°–860° F. temperature and 1500–3500 psig hydrogen partial pressure.

From the second stage reactor effluent 38 vapor and liquid fractions are separated at the existing high pressure in phase separator 40, and the vapor fraction 41 is passed to hydrogen purification unit 42 to provide a hydrogen recycle stream 43 and vent gas stream 45. From fractionator 50, the liquid fraction 44 is pressure-reduced at 47 so as to recover distillate liquid products in an atmospheric pressure fractionator 50 to produce gas at 51 and desired distillate liquid products at and 52. From fractionator 50, the bottoms liquid stream 55 is passed to a liquid-solids separation step 56, from which fine solids material of unconverted coal and ash are removed at 57.

If desired, a portion 58 of the atmospheric bottoms liquid from the liquid-solids separation step 56 can be advantageously recycled via pump 59 to the first stage reactor as the slurrying oil 15. If sufficient liquid hydrocarbon feedstock at 11 is used to slurry the coal feed, use of recycled process-derived slurrying oil 15 can be eliminated, to provide a once-through type operation for the feedstocks. Process-derived hydrocarbon streams which may be used for the coal slurrying oil include distillate liquid product, and 550° F.+ product oils which are recovered from the liquid-solids separation step at 56, which step may utilize hydroclones, filters, centrifuges, or solvent deashing techniques. The remainder of the atmospheric bottoms material from separation step 56 is vacuum distilled to recover a vacuum gas oil stream and a pumpable vacuum bottoms slurry material.

This invention will be further described by reference to the following Examples of operations, which would not be construed as limiting the invention.

EXAMPLE 1

Feed materials consisting of Alberta sub-bituminous coal alone, and also the coal mixed with equal portions of Cold Lake atmospheric residuum, were processed in a bench scale two-stage catalytic co-processing unit in accordance with this invention. Inspection analysis of the Alberta sub-bituminous coal is provided in Table 1, and analysis for the Cold Lake residuum material is provided in Table 2. The first and second stage catalytic reactors were operated at 750° F. and 825° F. temperature, respectively, and 2500 psig hydrogen partial pressure and at feed ratios for oil/coal/recycle liquids as indicated in Table 3. Comparative results of these operations are shown in Table 3.

TABLE 1

| ANALYSIS OF ALBERTA SUB-BITUMINOUS COAL | |
|---|---|
| Moisture, W % | 8–9 |
| Ultimate Analysis, W % Dry Basis | |
| Carbon | 67.7 |
| Hydrogen | 4.3 |
| Nitrogen | 1.5 |
| Sulfur | 0.7 |
| Ash | 8.0 |
| Oxygen (by difference) | 17.8 |
| | 100.0 |
| Hydrogen/Carbon Atomic Ratio | 0.76 |

TABLE 2

| ANALYSIS OF COLD LAKE RESIDUUM | |
|---|---|
| Gravity, ° API | 6.9 |
| Sulfur, W % | 5.2 |
| Carbon, W % | 83.1 |
| Hydrogen, W % | 10.2 |
| Nitrogen, W % | 0.5 |
| Oxygen, W % | 1.0 |
| Nickel, ppm | 93 |
| Vanadium, ppm | 240 |
| Weight percent 975° F. + material | 71.2 |

TABLE 2-continued

| ANALYSIS OF COLD LAKE RESIDUUM | |
|---|---|
| Hydrogen/Carbon Atomic Ratio | 1.46 |

TABLE 3

CATALYTIC TWO-STAGE CONDITIONS AND YIELDS

| Condition | A Coal Only | B Co-Processing |
|---|---|---|
| W %,Coal Feed | 100 | 50 |
| W % Oil Feed | 0 | 50 |
| Recycle Oil, W % on coal | 170 | 70 |
| First Stage Reactor Feed | | |
| W,% Coal | 37 | 37 |
| Oil/coal/recycle oil ratio | 0/1/1.7 | 1/1/0.7 |
| Feed Material Space Velocity | | |
| lbs coal/hr × $ft^3$ reactor | 20 | 20 |
| lbs coal + oil/hr × $ft^3$ reactor | 20 | 40 |
| First Stage Temperature, °F. | 750 | 750 |
| Second Stage Temperature, °F. | 825 | 825 |
| Reactor $H_2$ Partial Pressure, psig | 2500 | 2500 |
| Yields, W % Dry Feed | | |
| $C_1$–$C_3$ Gas | 6.1 | 3.8 |
| $C_4$–390° F. Liquid | 20.3 | 15.7 |
| 390–650° F. Liquid | 37.0 | 25.8 |
| 650–975° F. Liquid | 7.6 | 27.5 |
| 975° F. + Resid | 2.3 | 11.8 |
| Unconverted Coal | 8.1 | 4.2 |
| Ash | 8.0 | 4.0 |
| $H_2O$, CO, $CO_2$ | 16.0 | 8.0 |
| $NH_3$ | 1.5 | 0.7 |
| $H_2S$ | .4 | 2.7 |
| Total (100 + $H_2$ reacted) | 107.3 | 104.2 |
| $C_4$–975° F. Liquid | 64.9 | 69.0 |
| Performance Parameters | | |
| Coal Conversion, W % MAF Coal | 91.3 | 91.2 |
| 975° F. + Conversion, W % MAF Feed | 88.7 | 80.4 |
| $C_4$–975° F. Liquid, W % MAF Feed | 70.5 | 71.9 |
| Barrels of $C_4$–975° F./Liquid Metric Ton MAF Feed | 5.1 | 5.2 |

From these results, it is seen that for essentially twice as much feed material being co-processed through the two-stage catalytic reactors, the present co-processing process provides improved yields of $C_4$–975° F. liquids and reduced yields of $C_1$–$C_3$ gas. Furthermore, it is pointed out that the yield of $C_4$–975° F. material is actually increased for the present process.

EXAMPLE 2

Other similar catalytic hydroprocessing operations were carried out separately on the Cold Lake atmospheric residuum material and on Alberta sub-bituminous coal blended with different ratios of the residuum feed and recycled processed-derived oil. In an alternative process arrangement, the coal/oil co-processing of Cold Lake atmospheric resid and Alberta sub-bituminous coal was carried out in a once-through operating mode, i.e., without recycle of any process-derived liquid, with results being shown in Table 4.

TABLE 4

CATALYTIC TWO STAGE CO-PROCESSING YIELDS

Alberta Sub-Bituminous Coal/Cold Lake Atmospheric Residuum

| | | |
|---|---|---|
| Oil/Coal/Recycle Oil Weight Ratio | 1.7/1/0 | 1/1/0.7 |
| YIELDS, W % M.A.F. Coal Plus Oil | | |
| $C_1$–$C_3$ Gas | 2.7 | 3.8 |
| $C_4$–975° F. Liquid | 74.4 | 71.9 |
| Coal Conversion | 92 | 91 |
| 975% F. + Conversion | 80 | 80 |
| Hydrodesulfurization, % | 77 | 87 |
| Hydrodemetallization, % | — | — |
| Hydrogen Efficiency | 21 | 16 |
| $C_4$–975° F., Liquid Bbl/Metric Ton Fresh Feed | 5.4 | 5.2 |

These results show that comparable coal conversion, 975° F.+ conversion material and liquid product yields and hydrodesulfurization were achieved by catalytic two-stage hydroprocessing in accordance with the present invention, as compared to separate catalytic hydroconversion of these feed materials. Also, as shown in Table 4, the low temperature first stage reaction zone hydrogenates the feed coal and oil sufficiently such that use of process-derived recycle liquids can be eliminated. Results for the once-through operating mode similar to Example 1 coal/oil co-processing were obtained.

EXAMPLE 3

Other comparable two-stage catalytic operations were carried out which shows the advantage of recycling unconverted coal and ash solids to the first stage catalytic reactor in this two-stage coal/oil co-processing process, with the results being shown in Table 5.

TABLE 5

TWO-STAGE CO-PROCESSING WITH LIQUID RECYCLE

| | | |
|---|---|---|
| Coal in Fresh Feed, W % | 50 | 50 |
| First Stage Feed Ratio, Oil/Coal/Recycle Oil | 1/1/0.7 | 1/1/0.7 |
| Recycle Liquid Used | 550° F.+ Filtered Liquid Product | 550° F.+ Liquid Containing Solids |
| $C_1$–$C_3$ Gas, W % dry coal | 3.6 | 3.8 |
| $C_4$–975° F. Liquids, W % dry coal | 70.5 | 69.0 |
| Coal Conversion, W % MAF Coal | 88.7 | 91.2 (+ 2.5) |
| $C_4$ + Liquid, W % MAF Coal Feed | 82.1 | 84.2 (+ 2.1) |

From the results, it is seen that for otherwise equivalent operating conditions the recycle of unconverted coal and ash solids to the first stage reactor results in approximately 2.5% increase in the coal conversion and 2.1% increase in the production of $C_4$+ liquids, based on the M.A.F. coal feed.

Although this invention has been described broadly and in terms of certain preferred embodiment thereof, it will be understood that modification and variations of the process can be made within the spirit and scope of the invention, which is defined by the following claims.

We claim:

1. A two-stage continuous process for catalytic hydroconversion of a fluid blend of a solid carbonaceous material and heavy hydrocarbon liquid, comprising:

(a) mixing a solid carbonaceous particulate material with sufficient heavy hydrocarbon liquid having at least about 90 V% normally boiling above 650° F. to provide a flowable slurry mixture, the total hydrocarbon liquid/coal feed weight ratio being between about 1.0/1 and 3/1 with the solid carbonaceous material being between about 25 and 50 W% of the total feed material;

(b) feeding the flowable slurry mixture with hydrogen into a first stage back-mixed catalytic reaction zone containing an ebullated catalyst bed of particulate hydrogenation catalyst, said reaction zone having an internal liquid recycle; said catalyst containing an active metal component wherein the metal in said component is selected from the metals group consisting of cobalt, iron, molybdenum, nickel, tin, tungsten, and mixtures thereof on a support material, said catalyst bed being maintained at 650°-800° F. temperature, 1000-4000 psig hydrogen partial pressure and feed rate of 10-100 lb carbonaceous material plus heavy hydrocarbon liquid feed per hour per $ft^3$ reaction zone volume for hydrogenation reaction to partially hydrogenate and hydroconvert the feed materials to hydrocarbon material containing less than 6 W% $C_1$-$C_3$ hydrocarbon gases, 15-25 W% 650° F.− light liquid fraction and 60-70 W% 650° F.+ hydrocarbon material fraction;

(c) passing the total effluent material from said first stage reaction zone with additional hydrogen directly to a close-coupled second stage back-mixed catalytic reaction zone containing an ebullated catalyst bed so as to avoid forming retrograde materials in the effluent, said catalyst containing an active metal component wherein the metal in said component is selected from the metals group consisting of cobalt, iron, molybdenum, nickel, tin, tungsten and mixtures thereof on a support material, said second stage reaction zone being maintained at a higher temperature than the first stage reaction zone, and at 750°-900° F. temperature and 1000-4000 psig hydrogen partial pressure to convert the remaining unconverted carbonaceous material to hydrocarbon gases, hydrocarbon liquid fraction normally boiling between 400°-650° F. and including a high boiling residuum fraction;

(d) passing the resulting effluent material from said second stage reaction zone to successive phase separation and distillation steps to separate the gas material fraction; and (e) removing unconverted coal and ash solids material and a heavy hydrocarbon bottoms liquid material, and thereby producing low-boiling hydrocarbon liquid products normally boiling between 150° F. and 975° F.

2. The hydroconversion process of claim 1, wherein said solid carbonaceous material is sub-bituminous coal.

3. The hydroconversion process of claim 2, wherein the coal is Alberta sub-bituminous coal.

4. The hydroconversion process of claim 1, wherein said heavy hydrocarbon liquid is petroleum residuum.

5. The hydroconversion process of claim 4, wherein the petroleum residuum is Cold Lake atmospheric residuum.

6. The hydroconversion process of claim 1, wherein the first-stage reaction zone temperature is 700°-780° F., the second-stage reaction zone higher temperature is 780°-860° F., the hydrogen partial pressure in the first and second stage reaction zones is 1500-3500 psig, and the total feed rate is 15-75 lb carbonaceous material plus heavy hydrocarbon liquid/hour per $ft^3$ reaction zone volume.

7. The hydroconversion process of claim 1, wherein a portion of the heavy hydrocarbon bottoms liquid material is recycled to the slurry mixing step and mixed with the heavy hydrocarbon liquid.

8. The hydroconversion process of claim 1, wherein a hydrocarbon liquid residuum normally boiling above 550° F. and containing unconverted coal and ash solids in recycled to said coal mixing step.

9. The hydroconversion process of claim 1, wherein the hydrocarbon liquid feed contains at least about 20 W% aromatic compounds.

10. The hydroconversion process of claim 1, wherein said solid carbonaceous material is bituminous coal.

11. The hydroconversion process of claim 1, wherein said heavy hydrocarbon liquid is tar sands bitumen.

12. The hydroconversion process of claim 1, wherein said catalyst has a particle size range of 0.030-0.125 inch effective diameter.

13. A two-stage continuous process for catalytic hydroconversion of a fluid blend of sub-bituminous coal and petroleum atmospheric residuum liquid, the process comprising:

(a) mixing the particulate sub-bituminous coal with sufficient petroleum atmospheric residuum having at least about 90 V% normally boiling above 650° F. and containing at least about 20 W% aromatic compounds to provide a flowable slurry mixture, the total petroleum residuum/coal feed weight ratio being between 1.0/1 and 3/1, with the coal feed being between about 25 and 50 W % of the total hydrocarbon feed material;

(b) feeding the slurry mixture with hydrogen into a first stage back-mixed catalytic reaction zone containing an ebullated catalyst bed of particulate hydrogenation catalyst, said reaction zone having an internal liquid recycle ratio at least about 1:1, said catalyst containing an active metal component wherein the metal iin said component is selected from the group consisting of cobalt, iron, molybdenum, nickel, tin, tungsten, and combinations thereof deposited on a support material selected from the group consisting of alumina, magnesia, silica, titania and similar materials, said catalyst bed being maintained at 700°-780° F. temperature, 1500-3500 psig hydrogen partial pressure and feed rate of 15-75 pound coal plus petroleum residuum oil per hr per $ft^3$ reactor volume for hydrogenation and hydroconversion reactions to provide lower boiling hydrocarbon materials containing less than 6 W% $C_1$-$C_3$ hydrocarbon gases, 15-25 W% 650° F.− light liquid fraction and 60-70 W% 650° F.+ hydrocarbon material fraction;

(c) passing the total effluent material from said first stage reaction zone together with additional hydrogen directly to a close-coupled second stage back-mixed catalytic reaction zone so as to avoid forming retrograde materials in the effluent, said catalyst containing an active metal oxide or other metal compound selected from the metals group consisting of cobalt, iron, molybdenum, nickel, tin, tungsten and combinations thereof deposited on a support material selected from the group consisting of alumina, magnesia, silica, titania and similar materials, said second stage zone containing an ebullated catalyst bed maintained at a higher temperature than the first stage reaction zone, and at 780°-860° F. temperature, and 1500-3500 psig hydrogen partial pressure to hydroconvert the remaining coal and residuum material to hydrocarbon gases, hydrocarbon liquid fraction normally boiling between 400°-650° F. and including a high boiling residuum fraction;

(d) passing the resulting effluent material from said second stage reaction zone to successive phase separation and distillation steps to remove the gas material fraction; and (e) removing unconverted coal and ash solids material and a heavy hydrocarbon bottoms liquid material, recycling a hydrocarbon fraction normally boiling above about 550° F. to the coal slurrying step, and thereby producing a low-boiling hydrocarbon liquid products normally boiling between 150° and 975° F.

14. A two-stage continuous process for catalytic hydroconversion of a fluid blend of a bituminous coal and heavy hydrocarbon liquid, comprising:

(a) mixing a particulate bituminous coal with sufficient heavy hydrocarbon liquid having at least about 90 V% normally boiling above 650° F. to provide a flowable slurry mixture; the total hydrocarbon liquid/coal feed weight ratio being between about 1.0/1 and 3/1 with the bituminous coal material being between about 25 and 50 W % of the total feed material;

(b) feeding the flowable slurry mixture with hydrogen into a first stage back-mixed catalytic reaction zone containing an ebullated catalyst bed of particulate hydrogenation catalyst, said reaction zone having an internal liquid recycle ratio of at least about 1:1, said catalyst containing an active metal component wherein the metal in said component is selected from the group consisting of cobalt, iron, molybdenum, nickel, tin, tungsten, and mixtures thereof deposited on a support material, said catalyst bed being maintained at 650°-800° F. temperature, 1000-4000 psig hydrogen partial pressure and feed rate of 10-100 lb carbonaceous material plus heavy hydrocarbon liquid feed per hour per $ft^3$ reaction zone volume for hydrogenation reaction to partially hydrogenate and hydroconvert the feed materials to hydrocarbon gases, 15-25 W% 650° F.− light liquid fraction and 60-70 W% 650° F.+ hydrocarbon material fraction;

(c) passing the total effluent material from said first stage reaction zone together with additional hydrogen directly to a close-coupled second stage back-mixed catalytic reaction zone containing an ebullated catalyst bed so as to avoid forming retrograde materials in the effluent, said catalyst containing an active metal component wherein the metal in said component is selected from the group consisting of cobalt, iron, molybdenum, nickel, tin, tungsten and mixtures thereof deposited on a support material, said second stage reaction zone being maintained at a higher temperature than the first stage reaction zone, and at 750°-900° F. temperature and 1000-4000 psig hydrogen partial pressure to convert the remaining unconverted coal to hydrocarbon gases, a hydrocarbon liquid fraction normally boiling between 400°-650° F. and including a high boiling residuum fraction;

(d) passing the resulting effluent material from said second stage reaction zone to successive phase separation and distillation steps to separate the gas material fraction; and (e) removing unconverted coal and ash solids material and a heavy hydrocarbon liquid bottoms material, recycling a hydrocarbon fraction normally boiling above 550° F. to the coal slurrying step, and thereby producing low-boiling hydrocarbon liquid products normally boiling between 150° F. and 975° F.

* * * * *